United States Patent [19]

Lübitzsch et al.

[11] 4,195,628

[45] Apr. 1, 1980

[54] DEEP SEA DIVING SYSTEM HAVING A CLOSED RESPIRATORY GAS CIRCULATION SYSTEM

[75] Inventors: Wolfgang Lübitzsch, Lubeck; Joachim Gelhaus, Stockelsdorf, both of Fed. Rep. of Germany

[73] Assignee: Drägerwerk Aktiengesellschaft, Fed. Rep. of Germany

[21] Appl. No.: 844,835

[22] Filed: Oct. 25, 1977

[30] Foreign Application Priority Data

Oct. 23, 1976 [DE] Fed. Rep. of Germany ..... 2648141

[51] Int. Cl.[2] ..... B63C 11/20

[52] U.S. Cl. ..... 128/201.27

[58] Field of Search ..... 128/142 R, 142 G, 142.2, 128/142.3, 142.4, 142.5, 142.7, 145 R, 145.8, 204

[56] References Cited

U.S. PATENT DOCUMENTS

| | | | |
|---|---|---|---|
| 1,681,029 | 8/1928 | Cooke | 128/204 X |
| 3,924,616 | 12/1975 | Banjavich et al. | 128/142.3 |
| 3,965,892 | 6/1976 | Colston et al. | 128/142.3 |

*Primary Examiner*—Henry J. Recla

*Attorney, Agent, or Firm*—McGlew and Tuttle

[57] ABSTRACT

A deep sea diving circulation system for a diver at a diving depth from a station above the water level, comprises a closed respiratory gas delivery line from the station to the diver and a return line from the diver to the station. A $CO_2$ absorber is arranged in the delivery line above the water level along with means for sensing the value of the oxygen in the delivery line and for supplying a correct oxygen replacement. The respiratory gas is circulated by a compressor which is capable of producing the necessary pressure difference for the level of operation of the diver in respect to the surface. A bypass line is arranged to connect across the inlet and outlet to the compressor and the flow cross-section therethrough is controlled by the pressure in the line circulating system. Cylinders with pressurized breathing gas are connected into the circulating line system before the diver's helmet through a pressure reducer having an after pressure lower than the pressure in the line system before the diver's helmet. The carbon dioxide control device is arranged in a bypass line in the system located above the water surface and so is an oxygen control device. A pressure reducer is arranged in the circulating line system and it is actuated by the diving depth pressure.

11 Claims, 2 Drawing Figures

DEEP SEA DIVING SYSTEM HAVING A CLOSED RESPIRATORY GAS CIRCULATION SYSTEM

FIELD AND BACKGROUND OF THE INVENTION

This invention relates in general to deep diving systems and, in particular, to a new and useful deep sea diving system with a closed respiratory gas cycle through the diving chamber to the diver and back, including a carbon dioxide binding unit arranged in the line system above the water surface, and including an oxygen supply, and respiratory gas delivery means which are present above the water surface.

DESCRIPTION OF THE PRIOR ART

Respiration-physiological reasons necessitate the use of gas mixtures, e.g., oxygen-helium for deep diving. However, because of the high price of helium and the often difficult transportation and storage conditions, a respiratory gas supply in a loss-free closed cycle is an expedient solution. For reasons of safety to the diver, one is willing to waive the latter's autonomy and to connect him with the diving chamber for supplying him with respiratory gas by means of supply tubes and, moreover, with a large cycle device, with respiratory gas supply system stationed at the surface.

A deep diving system for tube-supplied deep diving equipment with a closed respiratory cycle is known, wherein a space of a decompression chamber set up at the surface, the underwater diving chamber, and the respiratory cycle of the diving equipment carried by the diver are interconnected in a "big cycle". The respiratory gas circulating device is contained in the decompression chamber. The interior of the decompression chamber is under a pressure corresponding to the diving depth pressure. The respiratory gas flows from the decompression chamber through $CO_2$ absorbers in the respiratory gas supply unit to the diving chamber; partially enters the diving chamber, and is partially transported onto the diver. The hoses of the diving apparatus are coupled through connections in the diving chamber and they re-enter the space of the decompression chamber. The respiratory gas supply and monitoring means, for maintenance of the desired oxygen partial pressure for the absorption of $CO_2$ and for measurement of the $CO_2$ content, are installed at the surface outside the pressure area.

The arrangement of the respiratory gas circulating unit inside of the deck decompression chamber makes access to the gas circulating means and heat removal difficult and, in addition, molestation by heat and noise when using the deck decompression chamber is inevitable. For reasons of safety, electric energy should be kept away from manned pressure chambers. Periodic monitoring is possible only during stoppages of operation. The dependence of the deep diving system on the decompression chamber makes it impossible to supply the divers and the decompression chamber with an optimal gas mixture because, for safety reasons, the diver in the water should be supplied with gases of higher oxygen partial pressure than the diver in the decompression chamber, and because divers who might possibly stay in the decompression chamber at the same time must be supplied with a respiratory mixture under a different pressure. (G. Haux "Tauchtechnik", Vol. I, Springer-Verlag 1969).

In another known diving system with a closed respiratory cycle, the diver is deployed from a diving chamber which is used as a work basis. The diver is connected with the diving chamber by a respiratory gas supply line with a supply system located at the surface. In the sequence of flow, the gas returning from the diver gets to the surface into a collecting vessel, which also serves as a pulsation damper and water separator. The internal pressure of the damper is below the water pressure prevailing at the diver. The oxygen content in it is monitored and kept constant by the addition of oxygen. Thus, the respiratory gas goes to two pumps which are disposed in a closed tank and are equipped with after-connected sound dampers. The first pump draws the respiratory gas from the diver through the collecting vessel and forces it into the tank. In so doing, it is again brought to the diving chamber pressure. The second pump takes the respiratory gas out of the tank and forces it through externally located $CO_2$ absorbers into a storage vessel, and it then flows to the diver again. The pressure in the interior of the storage vessel is above the water pressure prevailing at the diver, so that the line controls resistance can be overcome. A safety valve is provided at both pumps, as a bypass. They provide for a uniform load on the pumps, in that the delivered quantity, which is not needed to the outside, is recycled inside of the tank. The respiratory gas coming from the storage vessel passes through a check valve and a throttle valve into the diver's helmet. From there, it returns via a safety valve and a prepressure regulator as well as a water separator in the diving chamber to the collecting vessel. The diving chamber is provided with a gas reserve to supply to the diver in an emergency.

This known diving system is disadvantageous in that the tank with the pumps is maintained at the pressure of the diving chamber, i.e., approximately the pressure prevailing at the diver. Two pumps are accordingly required for this system, which results in increased costs. By the arrangement of the pumps in a pressure-proof tank, the removal of the heat of compression, as well as the dissipated heat of the drive, is impeded. Periodic monitoring is difficult and can occur practically only during stoppages of operation, during which the tank must be rendered pressureless. (GB 13, 94, 934).

SUMMARY OF THE INVENTION

The invention provides a deep sea diving system which, because of its simple construction, is easy to control and can be easily adapted to new conditions. It is also easy to integrate the system into existing diving chamber systems and it is easy to maintain.

According to the invention, the respiratory gas delivering apparatus is a compressor which generates the pressure difference necessary for circulating the gas volume of the respiratory gas cycle, and a portion of the closed line system.

The advantages achieved with the invention in particular are that the freely accessible compressor installed directly in the line system executes the circulation of the respiratory gas mixture in the respiratory gas cycle in a simple manner. Due to the low inherent volume, the total volume circulated remains small. It is thus adaptable to changing conditions rapidly and without delay. A special suction pump is not needed. In technical design, the deep diving system is easy to integrate into existing chamber systems because of its simplicity. The free accessibility of the compressor makes maintenance easy. It can be carried out practically without interruption of the diving. In addition, other advantages result as compared with an installation in a pressure chamber. Current lead-through or isolating transformation are not required. Increased splash losses in the drive system for the compressor do not occur, as the compressor drive is not exposed to gas of increased density. The electric motor does not require cooling. The cooling of the compressor is easy to accomplish. This means that the compression ratio can be selected liberally, permitting a simple and reliable pressure regulation and circulation and also the use of lung-automatic systems. A special chamber to receive the compressor is unnecessary, thereby affording advantages of weight and price.

In a variation of the invention, a bypass, controlled in its aperture cross-section by the pressure in the line system before the inlet or after the outlet, interconnects the inlet and outlet of the compressor. Thus, it is possible in a technically advantageously simple manner for the diver to adjust his respiratory gas requirement and flushing gas requirement entirely as he wishes, without detriment to his well-being due to varying pressures or resistances in the respiratory gas flow.

As a further variation, a gas reservoir is connected to the line system before the diver's helmet via a pressure reducer having an after-pressure lower than the normal pressure in the line system before the diver's helmet. With this equipment, the rendering of aid in case of any technical difficulties becomes possible in an advantageous manner and with safe operation, allowing the diver to continue working or to emerge. With this equipment, either a possible loss of respiratory gas is compensated or work can continue in the open system.

A $CO_2$ control device and an $O_2$ control device are arranged in a bypass line in the line system above the water surface to monitor the breathability of the respiratory gas. Measurement of the $CO_2$ and $O_2$ partial pressure of the respiratory gas is thus possible in a safe and uncomplicated manner.

As a further variant, a pressure reducer, controlled by the diving depth pressure, is arranged in the line system. This pressure reducer permits the depth-independent regulation of the respiratory gas quantity at the diver and a safe pressure regulation in the total system in a simple manner.

Accordingly, it is an object of the invention to provide a deep sea diving system for a diver at a diving depth from a station above water level comprising a closed circuit respiratory gas delivery line from the station to the diver and a return line from the diver to the station with a $CO_2$ absorber, oxygen supply means and respiratory gas circulating means in the delivery line above the water level wherein the respiratory gas circulating means comprises a compressor for producing a pressure difference necessary for the circulation of the respective gas volume at the diver's level.

A further object of the invention is to provide a deep sea diving system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
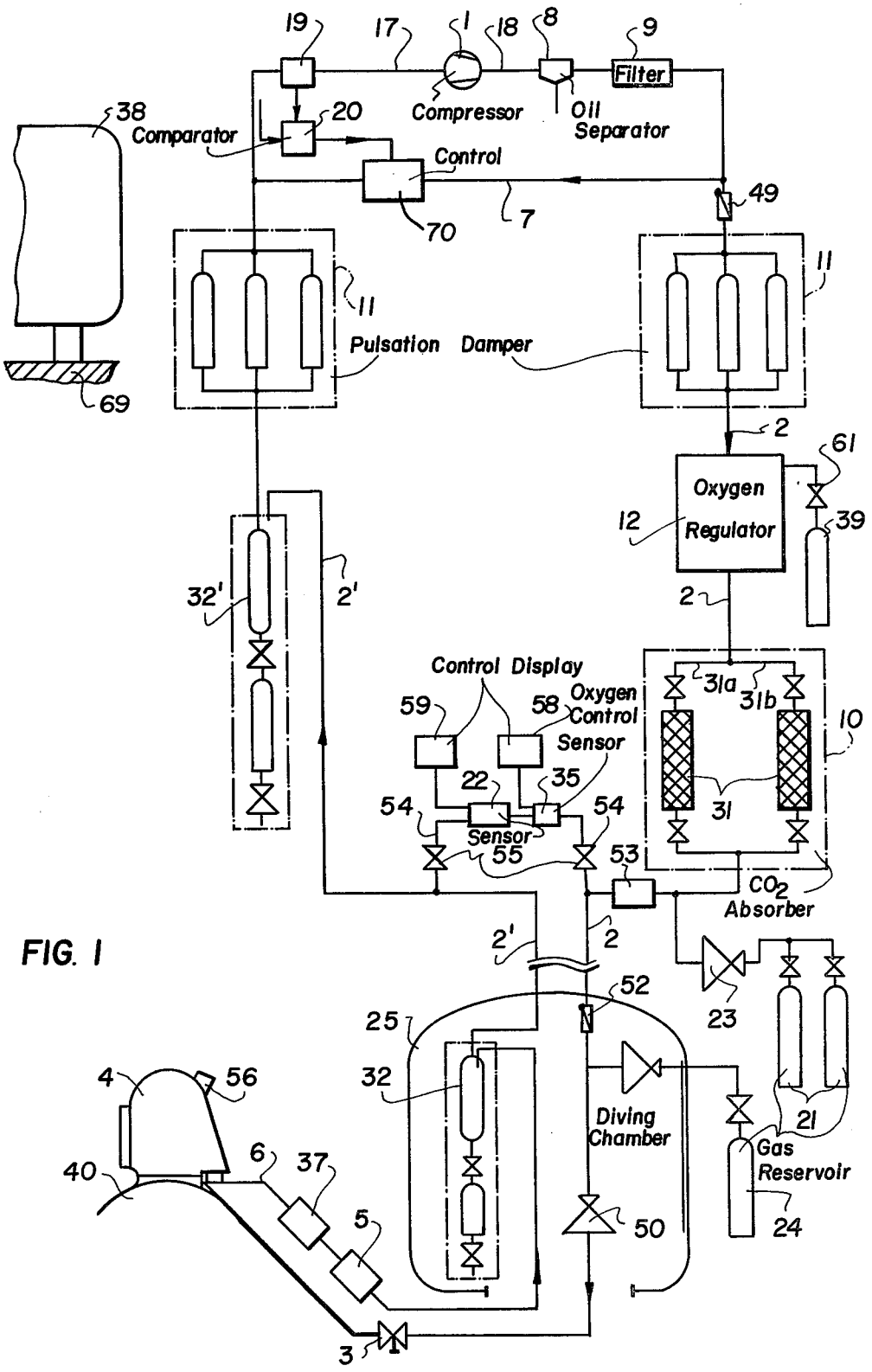
FIG. 1 is a schematic representation of a deep sea diving system constructed in accordance with the invention.

Referring to the drawings in particular, the invention embodied therein, comprises a deep sea diving system for a diver 40 located at a diving depth below a deck decompression system or station 38 located above water level, for example, on the deck of a vessel 69, comprising a closed circuit respiratory gas delivery line 2 extending from the station 38 above water level to the diver 40 at an operating level and a closed circuit respiratory gas return line from the diver to the station, designated 2'. In the embodiment shown, there is a station 38 above water level and a diving chamber 25 located below water level as an operating base for the diver.

The diver 40, using a diving chamber 25 as a work base, is supplied with respiratory gas by a respiratory gas cycle independent of the diving chamber 25 and a deck decompression system or station 38 on a vessel deck 69. Provision for the diver occurs in a closed cycle device or system from the surface. The cycle flow system comprises a compressor 1, an oil separator 8, an active carbon filter 9, a check valve 49, a first pulsation damper 11, an $O_2$ regulating system 12, a $CO_2$ absorber 10, a flow section 53, a check valve 52, a pressure reducer 50, a proportioning valve 3, a diver helmet 4, a safety valve 37, a back-pressure regulator 5, a water separator 32, a second pulsation damper 11, and the line system 2 and 2' which interconnects these separate elements. Apparatus at the diving depth for supplying respiratory gas directly to diver 40, such as the helmet 4 and its adjacent connection comprise diver breathing connection means.

Figure 2:
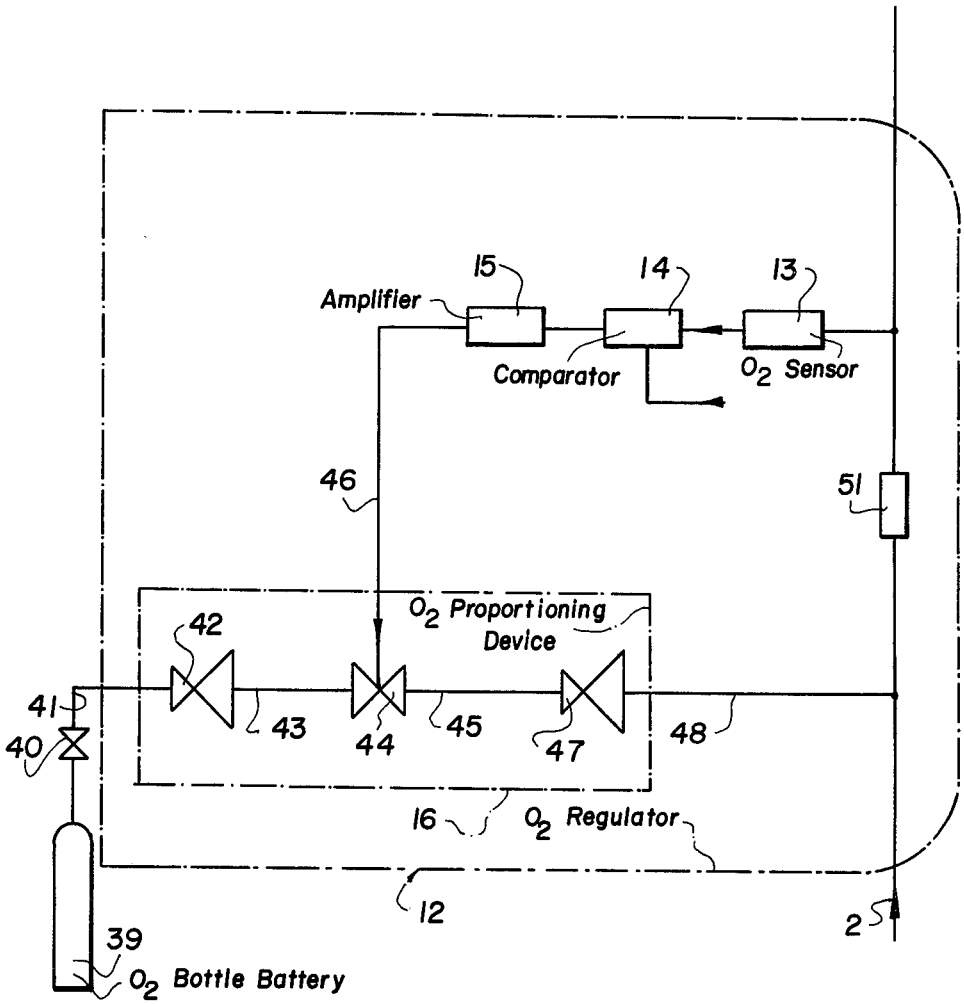
FIG. 2 is an enlarged schematic representation of the oxygen control system in the diving system shown in FIG. 1.

The compressor 1 has a continuous regulator in the bypass 7 to maintain the pressure. The oxygen regulating system 12, as shown in FIG. 2, provides for the replacement of the oxygen consumed by the diver. The system comprises $O_2$ sensors 13, which measure the oxygen partial pressure of the cycle gas, for example, in the expanded state. The regulating system 12 also includes a nominal-actual comparator 14, an amplifier 15, and an $O_2$ proportioning device 16.

As shown in FIG. 2, with the construction of the oxygen regulating system 12, the oxygen to be proportioned into the large respiratory cycle is stored in an oxygen bottle battery 39, and it is dispensed through a bottle valve 61 and supplied to the $O_2$ proportioning device 16 via the $O_2$ high-pressure line 41. The $O_2$ proportioning device 16 consists of the elements, pressure reducer 42, $O_2$ line 43, $O_2$ throttle 44, $O_2$ line 45, control line 46, back-pressure regulator 47, and $O_2$ line 48. The pressure reducer 42 reduces the oxygen pressure in the $O_2$ bottle battery 39 to a constant pressure in the $O_2$ line 43.

At this constant pressure, the oxygen is supplied to the $O_2$ throttle 44, which can be adjusted through the control line 46. The pressure behind the $O_2$ throttle 44 is maintained constant through the back-pressure regulator 47. By this arrangement, the oxygen supplied to the respiratory gas cycle via the $O_2$ line 48 becomes largely independent, with respect to its mass flow, of the system pressure behind the $O_2$ setting member, or of the storage pressure in the $O_2$ bottle battery 39. Further, with this arrangement, the pressure gradient between the $O_2$ high-pressure line 41 and the $O_2$ line 48 can be kept very small, so that despite a high counter-pressure in the respiratory gas cycle and thus also in the $O_2$ line 48, the $O_2$ reserve in the $O_2$ bottle battery 39 can be utilized optimally at great diving depths.

The $O_2$ content of the respiratory gas is monitored at water level by an $O_2$ sensor 35. Sensor 35 of this measuring system determines, for example, the $O_2$ partial pressure of the respiratory gas at diving depth pressure, which is indicated by the display device 58. Sensor 35 is arranged at the surface in a bypass line 54. In this bypass line 54, a pressure exists which is the same as that pressure existing at the diver's location. This pressure in line 54 can be adjusted by a suitable arrangement of pressure regulators and valves 55. This arrangement has the advantage that one can monitor the measured value of $O_2$ and $CO_2$ which prevail at the diver's location, on the surface and conversion of the measured partial pressure from the measured pressure to the diving depth pressure is eliminated. In the same bypass line 54, a sensor device 22 for $CO_2$ is installed. The measured value of 22 is indicated by the display instrument 59.

The respiratory gas is brought by the compressor 1 to an operating pressure which is above the diving depth pressure at which the diver works, by a sufficient amount. The gas thus compressed is supplied to the diver through the line system 2 and the pressure reducer 50 in the diving chamber 25 and is conducted through proportioning valve 3 into diver's helmet 4, in which the diver breathes freely. Pressure reducer 50 is actuated by the diving depth pressure and it facilitates the adjustment of the respiratory gas stream and simplifies the maintenance of pressure in the line system. The quantity of respiratory gas conveyed into the diver's helmet is large enough so that the $CO_2$ content in the helmet does not exceed the maximum permissible physiological value. The respiratory gas leaves the diver's helmet 4 through a line 6 via the safety valve 37 and the back-pressure regulator 5. The safety valve 37 and back-pressure regulator 5 are actuated by the ambient pressure and ensure that the pressure inside of the helmet is always above the ambient pressure of the diving depth by a small but constant value, regardless of the depth and of the magnitude of the respiratory gas stream through diver's helmet 4 set at the proportioning valve 3. The safety valve 37 ensures that even when the pre-pressure regulator 5 in the diver's helmet 4 fails, an unduly high vacuum relative to the surroundings cannot occur.

The respiratory gas leaving diver's helmet 4 is conveyed to compressor 1 via gas return line 6 as part of the line system 2' connected with inlet 17 of the compressor 1. This gas is expanded up to compressor 1 only so far that a sufficient pressure gradient exists for safe operation of the back-pressure regulator 5 at the helmet 4 and to overcome other line resistances. The pressure thus resulting at inlet 17 is increased in compressor 1 to an adjustable pressure value.

The control of bypass 7 at compressor 1 picks up the pressure at inlet 17 through sensor 19. This measured value is compared with the selected set assigned value in the comparator 20.

If the assigned value in the inlet 17 falls below its desired amount, i.e., with increasing closure of the proportioning valve 3 at the diver, bypass 7 is opened by control valve 70, so that the partial throughput of respiratory gas flowing through the line system 2 plus the partial throughput of respiratory gas through the bypass 7 is always equal to the total throughput of respiratory gas through the continuously operating compressor 1.

At preselected pressure at the inlet 17, a certain pressure will adjust itself at the outlet 18, depending on the quantity of respiratory gas in the total system. If this pressure is too low for the cycle of operation, respiratory gas must be added into the cycle in appropriate quantity from a gas reservoir 21 in the form of a battery of bottles. This can be done, for example, through a pressure reducer 23, the after-pressure of which is adjusted so that it corresponds to the desired operating pressure. Thereby, possible gas loss and resultant pressure drop on the high pressure side of the system can also be compensated automatically.

It is further possible in this manner, without any special control means, to continue supplying the diver with respiratory gas from the reservoir 21 at the surface as well as in the open system upon failure of the compressor 1, with the provision being made by the check valve 49 that no respiratory gas flows via the compressor 1 or the bypass 7 to the low pressure side. Similarly, as from the reservoir 21 at the surface, the diver can also be supplied from a gas reservoir 24 at the diving chamber 25 and a corresponding pressure reducer 26.

The $CO_2$ absorber 10 consists of two columns 31 connected in parallel by respective bypass lines **31*a* and 31*b*, so that change of absorber filling is possible during operation. Water separators 32 and 32' are arranged in the diving chamber 25 and at the surface, respectively. These serve the purpose of avoiding either water of condensation or water from the diver's helmet 4 seeping into the compressor or gas-processing system. Operation of the $O_2$ regulating system 12 may, for example, be continuous. Measuring can then be carried out under atmospheric pressure, for example. To this end, a quantity constant per unit time is taken from the respiratory gas cycle and passed along an $O_2$ sensor 13. The measured value is then compared with the assigned value, which corresponds to the oxygen content of the respiratory gas. In accordance with the difference between nominal and actual value, the $O_2$ proportioning device 16** is actuated, which proportions the oxygen into the cycle according to the consumption by the diver, independently of fore- or after-pressure.

While a specific embodiment of the invention has been shown and described in detail to illustrate the application of the principles of the invention, it will be understood that the invention may be embodied otherwise without departing from such principles.

What is claimed is:

1. A deep-sea diving system for a diver at a diving depth with a station adapted to be located above water level, comprising diver breathing connection means for supplying respiratory gas to the diver at the diving depth, a respiratory gas delivery line extending from the station adapted to be located at water level connected to said diver breathing connection means, and a return line connected to and extending from said diver breathing connection means back to the station, a $CO_2$ absorber connected in said delivery line, oxygen supply means connected in said delivery line, and respiratory gas circulating means connected in said delivery line, said $CO_2$ absorber, oxygen supply means and respiratory gas circulating means all adapted to be located above water level, said respiratory gas circulating means comprising a single compressor connected directly between said gas return and delivery lines for producing a pressure difference necessary for the circulation of the respiratory gas volume at the diving depth, said compressor including an inlet and an outlet, a bypass control line connected between said inlet and outlet of said compressor, means for sensing the pressure in said return line adjacent said inlet and connected to said bypass control line and means for controlling the cross-sectional flow through said bypass line from said outlet back to said inlet to increase the cross-sectional flow when the pressure in the return line drops below a selected value, to permit a constant flow through said compressor equal to the sum of a flow in said bypass control line plus a flow through said delivery line.

2. A deep-sea diving system, according to claim 1, wherein said control means comprises a control valve in said bypass line for regulating said cross-sectional flow therein, a sensor in the inlet of said compressor for sensing a pressure in said outlet and comparator means for comparing said selected pressure with the pressure in said inlet connected from said sensor to said control valve for regulating said cross-sectional flow returned through said bypass control line to said compressor inlet.

3. A deep sea diving system, according to claim 2, including a gas reservoir for breathing gas connected to said delivery line at a location adjacent the diver and pressure reducer means in the connection between said breathing gas reservoir and said diver.

4. A deep sea diving system, according to claim 1, including a pressure reducer in said delivery line located at diving depth pressure connected in said delivery line.

5. A deep sea diving system, according to claim 1, including a respiratory gas pulsation damper in said delivery line, said carbon dioxide absorber having first and second branch lines with first and second carbon dioxide absorbers therein and means for selectively passing the recirculating gas through a selected one of said first and second branch lines.

6. A deep sea diving system, according to claim 1, wherein said oxygen supply means includes an oxygen regulator comprising an oxygen bottle battery connected to said delivery line, an oxygen proportioning device connected between said bottle battery and said delivery line, an oxygen sensor in said delivery line connected to said oxygen proportioning device for regulating the amount of oxygen delivered to said delivery line.

7. A device according to claim 1, including a diver's helmet adapted to be worn by the diver connected between said delivery line and said return line, said return line having a prepressure regulator for controlling the pressure delivered to the diver's helmet so that it remains above the pressure at the operating depths.

8. A deep sea diving system according to claim 1, including a diving chamber located at the depth of the diver, said closed respiratory gas delivery line extending between the station and said diving chamber to the diver and back.

9. A deep-sea diving system, according to claim 1, wherein said oxygen supply means includes an oxygen regulator comprising an oxygen bottle battery connected to said delivery line, an oxygen proportioning device connected between said bottle battery and said delivery line, an oxygen sensor in said delivery line connected to said oxygen proportioning device for regulating the amount of oxygen delivered to said delivery line, said oxygen proportioning device comprising a high-pressure line from said bottle battery, a first pressure reducer connected to said high pressure line and $O_2$ connected to said first pressure reducer, a throttle valve connected to said $O_2$ line, a second $O_2$ line connected to said throttle valve, and a back-pressure regulator connected between said second $O_2$ and said delivery line, said oxygen sensor connected to said throttle valve for regulating the flow of oxygen through said first and second $O_2$ line.

10. A deep-sea diving system, according to claim 1, further including an oxygen and carbon dioxide monitoring bypass line connected between said delivery line and said return line, pressure regulator and valve means connected at either end of said oxygen and carbon dioxide monitoring bypass line and said return line and delivery line respectively for providing a pressure in said oxygen and carbon dioxide bypass line which is substantially equal to the pressure in the area of the diver, an oxygen sensor and a carbon dioxide sensor in said oxygen and carbon dioxide monitoring bypass line, an oxygen level monitor connected to said oxygen sensor and a carbon dioxide level monitor connected to said carbon dioxide sensor for displaying respective partial pressure values for oxygen and carbon dioxide in said return and delivery lines, said displays, oxygen and carbon dioxide sensors and regulator and valve means being adapted to be located above the water level.

11. A deep-sea diving system with a surface station adapted to be located above water line for a diver at a diving depth, comprising a respiratory gas delivery line extending from the station adapted to be located at water level to the diver and a return line from the diver to the station, a diving helmet adapted to be worn by the diver connected to said delivery line and to said return line, a diving chamber in the vicinity of the diver adapted to envelop a portion of said delivery and return lines, a single compressor at said station between said return and delivery lines for producing a pressure difference necessary for the circulation of a respiratory gas volume in said diving helmet, a bypass line connected between said delivery line and said return line in the vicinity of said single compressor, a control valve in said bypass line for controlling flow therein, a pressure sensor in said return line adjacent said compressor for sensing an actual pressure in said return line adjacent said compressor, a comparator means connected between said pressure sensor and said control valve for comparing a preselected pressure with the actual pressure in said return line adjacent said compressor and opening said control valve when said actual pressure drops below said selected pressure for permitting a constant flow thr ›ugh said compressor equal to the sum of flows through said bypass line and said return line, first and second pulsation dampers in said delivery and return lines respectively for dampening pulsations from said single compressor, an oxygen regulator in said delivery line downstream of said first pulsation damper, said oxygen regulator comprising an oxygen sensor connected to said delivery line for sensing the oxygen content of flow in said delivery line, a comparator connected to said oxygen sensor for comparing the value of oxygen content from said sensor with a selected oxygen content value, an amplifier for amplifying the difference between said actual and selected oxygen content values, a throttle valve control line connected to said amplifier, a throttle valve connected to said throttle valve control openable with an increased difference between said actual and compared oxygen content, an oxygen bottle battery connected to said throttle valve, a pressure reducer connected between said oxygen bottle battery and said throttle, said throttle connected to said delivery line for delivering oxygen thereto and a back-pressure valve connected between said throttle valve and said delivery line, a carbon dioxide absorber in said delivery line downstream of said oxygen regulator, said carbon dioxide absorber comprising twin carbon dioxide absorbing elements which are connected in parallel to said delivery line, a gas reservoir connected to said delivery line through a pressure reducer downstream of said carbon dioxide absorber, a first check valve upstream of said first pulsation damper in said delivery line and a second check valve in said delivery line downstream of said gas reservoir and in said diving chamber, a supplemental gas reservoir associated with said diving chamber connected to said delivery line downstream of said second check valve, a pressure reducing valve in said delivery line downstream of said supplementary gas reservoir, a proportioning valve in said delivery line downstream of said last-mentioned pressure reducing valve, said proportioning valve connected to said diving helmet, a safety valve in said return line adjacent said diving helmet, a second back-pressure regulator in said return line downstream of said safety valve, a water separator downstream of said second back-pressure valve and in said diving chamber, an oxygen and carbon dioxide bypass line connected between said delivery line downstream of said carbon dioxide absorber and said return line upstream of said second pulsation damper, an oxygen sensor and a carbon dioxide connected in series in said oxygen and carbon dioxide bypass line, first and second regulator and valve means connected between respective ends of said oxygen and carbon dioxide bypass line and said delivery line and return line respectively for providing a pressure in said oxygen and carbon dioxide bypass line which is substantially equal to the pressure in the vicinity of the diver, and display means connected respectively to said oxygen sensor and to said carbon dioxide sensor for monitoring the oxygen and carbon dioxide levels in said return and delivery line.

* * * * *